United States Patent [19]

Ishii

[11] Patent Number: 4,936,695

[45] Date of Patent: Jun. 26, 1990

[54] GEAR ENGAGING MECHANISM FOR A PAPER HANDLING DEVICE

[75] Inventor: Hidekazu Ishii, Shizuoka, Japan

[73] Assignee: Tokyo Electric Co., Ltd., Tokyo, Japan

[21] Appl. No.: 245,830

[22] Filed: Sep. 19, 1988

[30] Foreign Application Priority Data

Sep. 17, 1987 [JP] Japan ..... 62-232964
Dec. 28, 1987 [JP] Japan ..... 62-336630

[51] Int. Cl.[5] ..... B41J 11/50

[52] U.S. Cl. ..... 400/605; 400/616.2; 74/470

[58] Field of Search ..... 400/605, 606, 607, 607.1, 400/607.2, 607.3, 608, 608.1, 608.2, 608.3, 608.4, 613.2, 616, 616.1, 616.2, 624, 629, 634, 635, 636, 636.1, 636.2, 637, 639, 639.1, 639.2; 74/339, 352, 353, 354, 469, 470, 491, 504, 665 F, 665 G, 665 GA, 665 GB

[56] References Cited

U.S. PATENT DOCUMENTS

| | | | |
|---|---|---|---|
| 2,115,849 | 5/1938 | Gustavson | 74/470 |
| 2,701,479 | 2/1955 | Kuntny | 74/470 |
| 3,646,832 | 3/1972 | Hirafuji | 74/470 |
| 3,961,542 | 6/1976 | Fulghum et al. | 74/470 |
| 4,360,279 | 11/1982 | Sugiura | 400/605 |
| 4,572,418 | 1/1986 | Hirata | 400/616.2 |
| 4,688,957 | 8/1987 | Prevignano | 400/637.2 |
| 4,722,624 | 2/1988 | Musso | 400/639.1 |

FOREIGN PATENT DOCUMENTS

| | | | |
|---|---|---|---|
| 255876 | 11/1986 | Japan | 400/605 |
| 99171 | 5/1987 | Japan | 400/607 |
| 249772 | 10/1987 | Japan | 400/616.2 |

*Primary Examiner*—David A Wiecking
*Attorney, Agent, or Firm*—Oblon, Spivak, McClelland, Maier, & Neustadt

[57] ABSTRACT

A paper handling device including a first gear attached to a first paper feed device, such as a platen, and engaging a driving pinion; a second gear attached to a second paper feed device, such as a tractor unit, located in a plane including the first gear, and separated from the first gear; an operating shaft rotatably extended in parallel to the respective axes of the first and second gears; an active swing arm fixedly mounted on the operating shaft; a passive swing arm mounted on the operating shaft for free swing motion relative to the operating shaft; an idle gear pivotally supported on the free end of the passive swing arm and capable of engaging both the first and second gears; and an elastic member interconnecting the active swing arm and the passive swing arm. The idle gear is caused to engage both the first and second gears securely and properly by the agency of the elastic member or to be disengaged from both the first and second gears for selectively driving the first paper feed means or the second paper feed means.

4 Claims, 9 Drawing Sheets

GEAR ENGAGING MECHANISM FOR A PAPER HANDLING DEVICE

FIELD OF THE INVENTION

The present invention relates to a paper handling device for printers and, more particularly, to a paper handling device equipped with two kinds of paper feeding mechanisms namely a platen for feeding a cut sheet and a tractor for feeding a continuous fanfold paper.

BACKGROUND OF THE INVENTION

Generally, the recent printer is required to be able to handle both cut sheets and continuous fanfold papers. Since the cut-sheet feed system for feeding cut sheets and the fanfold paper feed system for feeding continuous fanfold papers are different from each other, the paper handling mode of the printer must be changed selectively between a mode using the cut-sheet feed system and a mode using the fanfold paper feed system. The cut-sheet feed system presses a cut sheet against a platen with a pinch roller and rotates the platen to feed the cut sheet by the frictional traction of the platen. The fanfold paper feed system has tractor wheels which engage perforations formed in the edge of a fanfold paper and rotate to feed the fanfold paper by traction. It sometimes becomes necessary during printing operation for printing on a fanfold paper to interrupt printing on a fanfold paper and to print temporarily on a cut sheet. In such a case, the fanfold paper is not removed from the printer and is retracted from the platen with the tractor wheels engaging the perforations of the fanfold paper to a predetermined standby postion, a cut sheet is pressed against the platen with the pinch roller for printing, and then the fanfold paper is brought again into engagement with the platen to restart printing on the same fanfold paper after the printing operation for printing on the cut sheet has been completed. If power is transmitted continuously to the tractor wheels while the tractors are held at a standby position, the fanfold paper held standby is moved to cause jamming or the displacement of the present print line. Accordingly, it has been necessary to transmit power to the tractor wheels for printing on a fanfold paper and to disconnect the tractor wheels from the driving source during printing on a cut sheet.

FIGS. 17 and 18 illustrate a conventional paper feed mode change-over mechanism. A platen 1 is mounted fixedly on a platen shaft 2 supported substantially in a horizontal position for rotation on a frame, not shown. A print head 3 is provided for reciprocation along the platen 1. A driven gear 4 fixed to one end of the platen shaft 2 is in continuous engagement with a driving gear 5 which is driven by a driving device, not shown. A tractor unit 6 includes a tractor shaft 7 and a tractor gear 8 fixed to one end of the tractor shaft 7 so as to be located in a plane including the driving gear 4 and separated from the driven gear 4. A swing arm 10 has one end rotatably supporting an idle gear 9 and the other end provided with a slot 11 having two parallel sides. A rotary shaft 12 extended in parallel to the platen 1 has one end fixedly connected to a lever 13 and the other end having a shaped portion 14 having two flat surfaces and pressed in the slot 11 of the swing arm 10 supporting the idle gear 9 to connect fixedly the rotary shaft 12 and the swing arm 10. When the rotary shaft 12 is turned by the lever 13 in one direction or the other, the swing arm 10 is caused to swing to a position where the idle gear 9 engage both the driven gear 4 and the tractor gear 8 or to a position where the idle gear 9 is disengaged from both the driven gear 4 and the tractor gear 8. Thus, the driven gear 4, the tractor gear 8, and the idle gear 9 constitute an interlocking gear train A.

The printer equipped with this paper feed mode changeover mechanism is able to use both cut sheets and fanfold papers. In printing on a cut sheet, the lever 13 is turned in a counterclockwise direction as viewed in FIG. 17. Thereby the rotary shaft 12 and the swing arm 10 fixed to the rotary shaft 12 are caused to turn in a counterclockwise direction through a predetermined angle to disengage the idle gear 9 from both the driven gear 4 and the tractor gear 8 so that power transmission to the tractor unit 6 is interrupted. Then, the cut sheet is inserted between the platen 1 and the pinch roller (not shown) and is fed frictionally by the platen 1 as a platen 1 is rotated, while the print head 3 reciprocates along the platen 1 for printing.

In printing on a fanfold paper, the lever 13 is turned in a clockwise direction as viewed in FIG. 17 and is held at a fixed position. Consequently, the rotary shaft 12 and the swing arm 10 fixed to the rotary shaft 12 are turned in a clockwise direction through a predetermined angle to bring the idle gear 9 into engagement with both the driven gear 4 and the tractor gear 8, and thereby power is transmitted to the tractor unit 6. In this state, the pinch roller is separated from the platen 1 and a tractor wheel 15 of the tractor unit 6 engages the perforations formed in the edge of the fanfold paper. The fanfold paper slips at a small slip rate relative to the surface of the platen 1 as the same is fed by the tractor unit 6 at the feed rate of the tractor unit 6, while the print head 3 reciprocates along the platen for printing.

This known paper feed mode changeover mechanism is capable of connecting the tractor unit 6 to and disconnecting the same from the driving unit through a simple operation. However, the known paper feed mode changeover mechanism has problems. Although the paper feed mode changeover mechanism is designed so that the idle gear 9 is able to engage properly both the driven gear 4 and the tractor gear 8, the paper feed mode changeover mechanism must be constructed in a high accuracy to make the idle gear 9, which moves along a circular path, engage both the driven gear 4 and the tractor gear 8 exactly . It often occurs in the interlocking gear train A that although able to engage one of the two gears 4 and 8 exactly, the idle gear 9 is unable to engage the other gear exactly. Furthermore, it is possible that the gear teeth are damaged or the shafts are distorted when the idle gear 9 is caused to engage the gears 4 and 8 forcibly with the tooth crests thereof in contact with those of the gears 4 and 8. Even if the gears are brought into engagement smoothly, the gears are not necessarily engaged properly due to inevitable errors in size of the parts that is, it is possible that the depth of engagement is excessively large or excessively small. If the printer is operated with the gears 4, 8, and 9 of the interlocking gear train A engaged in an excessively large depth of engagement, the gear teeth are abraded rapidly, parts of the printer are worn rapidly, and prints are deformed because the gears in the interlocking gear train A are unable to function smoothly. On the other hand, if the gears are engaged in an excessively small depth of engagement, the excessive backlash causes free movement of the gears relative to each other entailing the deformation of prints. Furthermore, since the elongated swing arm 10 supporting the idle gear 9 on the extremity thereof is unable to hold the idle gear 9 firmly in engagement with the driven gear 4 and the tractor gear 8, the idle gear 9 is liable to be disengaged easily from the driven gear 4 and the tractor gear 8 when an excessive torque is applied thereto in reversing the paper feed direction.

These troubles can be obviated by forming the parts in a higher accuracy to locate the idle gear 9 at an optimum position and by controlling the phases of the gears 4, 8, and 9 so that the tooth crests of the mating gears will not come into abutment with each other in engaging the gears 4, 8, and 9, or by employing a mechanism capable of firmly holding the idle gear 9 in engagement with the driven gear 4 and the tractor gear 8 and capable of fine positional adjustment of the idle gear 9. However, such measures require a sophisticated mechanism and entail difficulties in design, manufacture, and maintenance, deterioration of the accessibility of the printer, and increase in the manufacturing cost. Thus, these measures are not practically applicable.

OBJECTS

Accordingly, it is a first object of the present invention to ensure the selective driving of a first paper feed unit and a second paper feed unit.

It is a second object of the present invention to enable an idle gear to engage properly both a gear of the first paper feed unit and a gear of the second paper feed.

It is third object of the present invention to enable the idle gear to engage elastically both the gears of the first and second paper feed units.

It is a fourth object of the present invention to hold the idle gear in stable engagement with both the gears of the first and second paper feed units.

DETAILED DESCRIPTION OF THE PREFERRED EMBODIMENTS

First Embodiment (FIGS. 1 to 4)

Figure 1:
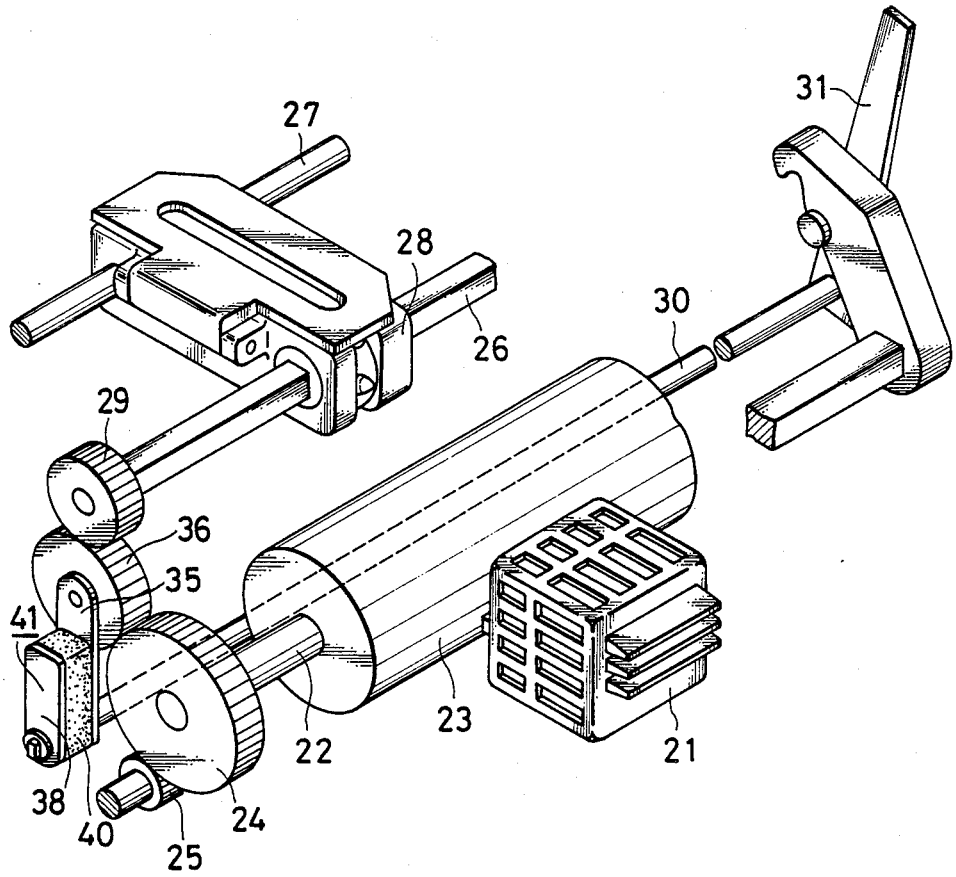
FIG. 1 is a perspective view partly broken away of a paper handling device in a first embodiment according to the present invention.
Figure 2:
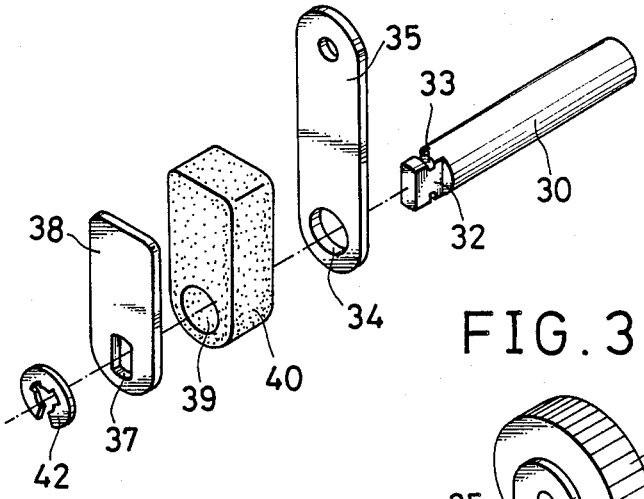
FIG. 2 is an exploded perspective view of an essential portion of the paper handling device of FIG. 1.
Figure 3:
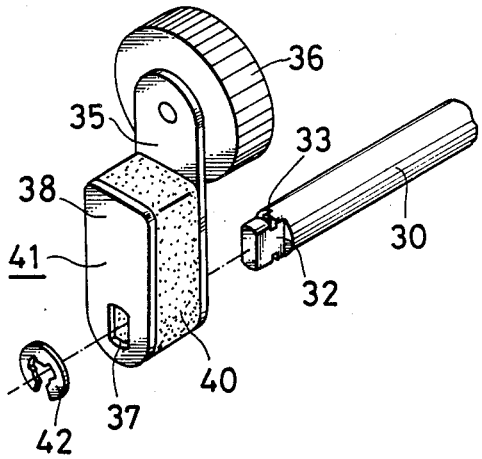
FIG. 3 is an exploded perspective view showing the relation between a swing arm assembly and a driving shaft in the paper handling device of FIG. 1.

A print head 21 is disposed for horizontal reciprocating motion, and a platen 23 (first paper feed means) integrally having a platen shaft 22 is disposed horizontally with the axis thereof in parallel to the direction of movement of the print head 21. A platen gear (first gear) 24 fixedly mounted on one end of the platen shaft 22 is in mesh with a driving pinion 25 which is driven by a driving unit, not shown.

A tractor driving shaft 26 having a square cross section and a guide shaft 27 having a circular cross section are extended in parallel to each other. A tractor unit 28 (second paper feed means) is mounted on the tractor driving shaft 26 and the guide shaft 27 so as to be movable along the tractor driving shaft 26 and the guide shaft 27 for positional adjustment. A tractor gear (second gear) 29 is fixedly mounted on one end of the tractor driving shaft 26 so as to be located apart from the platen gear 24 in a plane including the platen gear 24.

An operating shaft 30 is extended with its axis in parallel to those of the platen gear 24 and the tractor gear 29. The operating shaft 30 has one end connected to a manual lever 31 and the other end provided with a holding portion 32 having two parallel flat surfaces and provided with a groove 33 for receiving a retaining ring 42 therein.

A passive swing arm 35 has one end provided with a circular through hole 34 for receiving the operating shaft 30 in a loose fit and the other end rotatably supporting an idle gear 36 which engages both the platen gear 24 and the tractor gear 29. An active swing arm 38 having an effective length smaller than that of the passive swing arm 35 and provided with a slot 37 fitting the holding portion 32 of the operating shaft 30 and having parallel sides is mounted on the extremity of the holding portion 32 of the operating shaft 30 opposite to the passive swing arm 35. An elastic member 40, such as a rubber block, is interposed between the passive swing arm 35 and the active swing arm 38 and is attached by suitable means, such as an adhesive, to both the passive swing arm 35 and the active swing arm 38. The passive swing arm 35, the active swing arm 38, and the elastic member 40 constitute a swing arm assembly 41.

The swing arm assembly 41 is mounted on the holding portion 32 of the operating shaft 30, and the retaining ring 42 is fitted in the groove 33 to hold the swing arm assembly 41 in place on the operating shaft 30. In this state, the parallel sides of the slot 37 of the active swing arm 38 engage the parallel flat surfaces of the holding portion 32, so that the active swing arm 38 is restrained from turning relative to the operting shaft 30.

The lever manual 31 is operating to turn the operating shaft 30 in one direction or the other to bring the idle gear 36 supported on the passive swing arm 35 of the swing arm assembly 41 into engagement with the platen gear 24 and the tractor gear 29 or to disengage the idle gear 36 from the platen gear 24 and the tractor gear 29. The platen gear 24 is driven continuously for rotation by the driving pinion 25.

Figure 4:
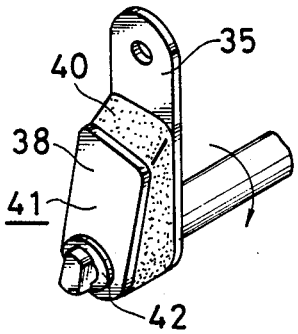
FIG. 4 is a perpective view showing the distortion of an elastic member of the swing arm assembly of FIG. 3.
Figure 5:
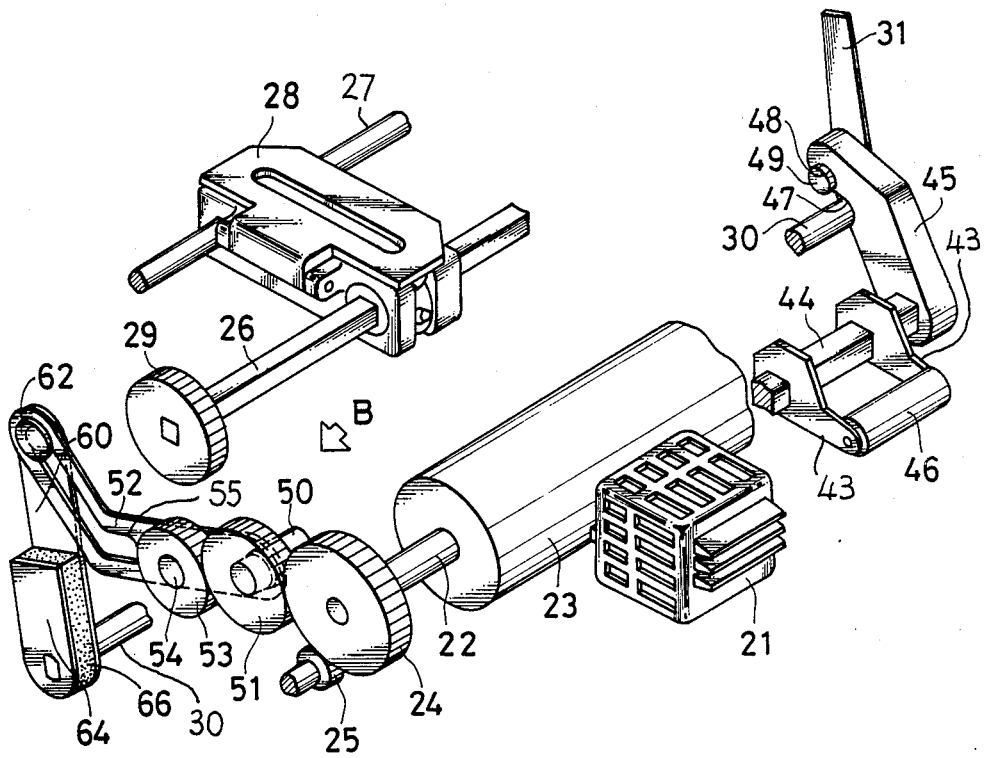
FIG. 5 is a perspective view partly broken away of a paper handling device in a second embodiment according to the present invention.
Figure 6:
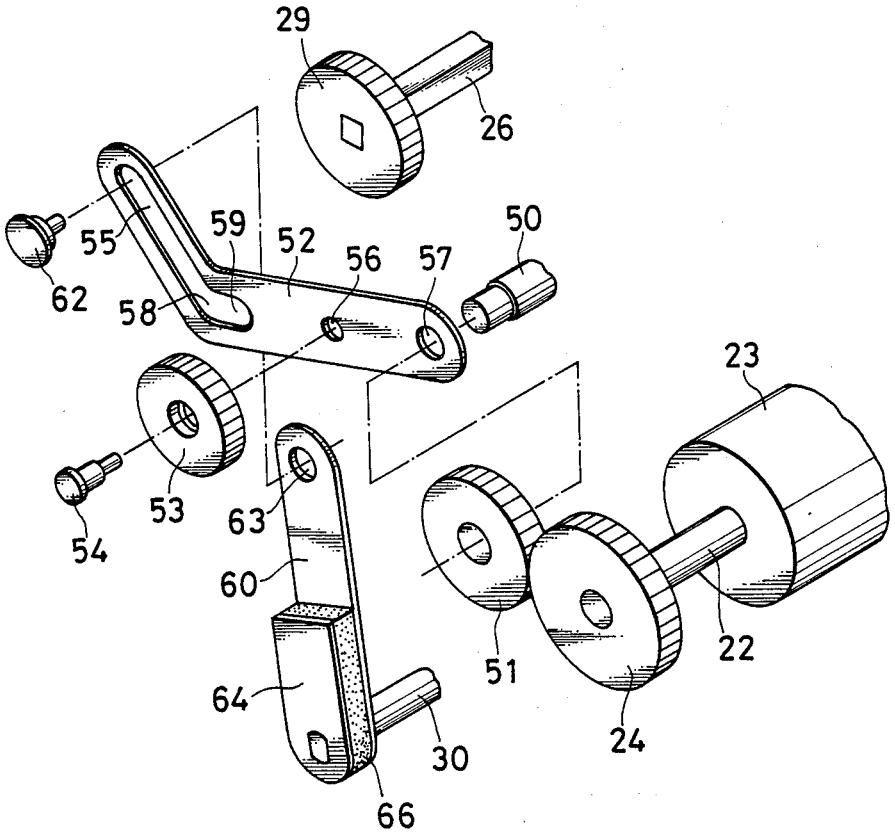
FIG. 6 is an exploded perspective view of an essential portion of the paper handling device of FIG. 5.

While the idle gear 36 is disengaged from the platen gear 24 and the tractor gear 29, only the platen gear 24 is driven by the driving pinion 25, and hence the platen 23 is rotated for feeding a cut sheet. When the operating shaft 30 is turned through a predetermined angle to bring the idle gear 36 into engagement with both the platen gear 24 and the tractor gear 29, the elastic member 40 is distorted as shown in FIG. 4, so that the idle gear 36 engages the platen gear 24 and the tractor gear 29 elastically. Consequently, the idle gear 36 engages the platen gear 24 and the tractor gear 29 properly; namely, the idle gear 36 engages the platen gear 24 and the tractor gear 29 neither in an excess depth nor in an insufficient depth, so that power is transmitted efficiently from the platen gear 24 through the idle gear 36 to the tractor gear 29, and thereby the tractor unit 28 feeds a continuous paper, such as a fanfold paper, smoothly.

Since the engagement of the idle gear 36 with the platen gear 24 and the tractor gear 29 is adjusted properly by the agency of the elastic member 40, the free position of the idle gear 36 defined by the angular position of the operating shaft 30 need not be determined accurately. Accordingly, the parts associated with the swing arm assembly 41 need not be finished in a particularly high accuracy, and the swing arm assembly 41 can be assembled and adjusted simply.

Second Embodiment (FIGS. 5 to 13)

In FIGS. 5 to 13, parts like or corresponding to those described previously with reference to FIGS. 1 to 4 are denoted by the same reference numerals and the description thereof will be omitted.

Referring to FIGS. 5 to 8, the arrangement and configuration of a print head 21, a platen 23 (first paper feed means), a platen gear (first gear 24), a platen shaft 22, a driving pinion 25, a tractor driving shaft 26, a guide shaft 27, a tractor unit 28 (second paper feed means), and a tractor gear 29 (second gear) are similar to those of the corresponding parts of the first embodiment.

A stopper 45 is fixed to one end of a stopper shaft 44 supported rotatably on a frame, not shown. A pinch roller 46 is supported rotatably on arms 43 mounted on the stopper shaft 44. The arms 43 are restrained from rotation relative to the stopper shaft 44. The pinch roller 46 is disposed under the platen 23. Recesses 47 and 48 are formed at a predetermined interval in the stopper 45. A manual lever 31 is fixed to one end of an operating shaft 30 and is provided with a pin 49. When the pin 49 of the manual lever 31 engages the recess 47, a second idle gear 53 engages the tractor gear 29, and the pinch roller 46 is held apart from the platen 23. When the pin 49 engages the recess 48, the second idle gear 53 is disengaged from the tractor gear 29, and the pinch roller 46 is held pressed against the platen 23.

A first shaft 50 is supported on the frame, not shown, so as to extend in parallel to the platen 23. A first idle gear 51 is supported rotatably on the first shaft 50 and engages the platen gear 24 continuously. The center distance between the first shaft 50 and the platen shaft 22 corresponds to the optimum center distance between the platen gear 24 and the first idle gear 51. A crooked guide plate 52 is mounted on the first shaft 50 for turning motion relative to the first shaft 50. The second idle gear 53 is supported rotatably on a pivot shaft 54 fixed to the crooked guide plated 52 and engages the first idle gear 51 continuously. The platen gear 24, the first idle gear 51, the second idle gear 53, and the tractor gear 29 constitute an interlocking gear train B. The crooked guide plate 52 is provided with a guide slot 55 extending from one end to a bent portion of the crooked guide plate 52, a second through hole 56 for receiving the pivot shaft 54 rotatably supporting the second idle gear 53, and a first through hole 57 for receiving the first shaft 50. The center distance between the first through hole 57 and the second through hole 56 corresponds to the optimum center distance between the first idle gear 51 and the second idle gear 53. A bend 58 is formed in the guide slot 55 near the middle portion of the crooked guide plate 52. Indicated at 59 is a holding part formed in the bend 58.

Figure 9:
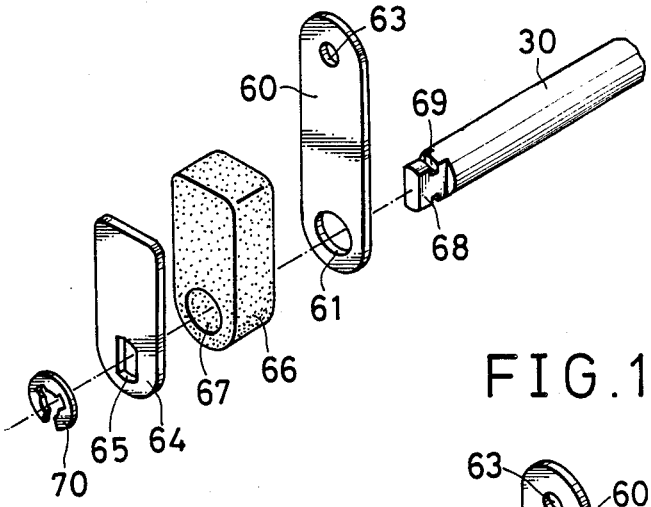
FIG. 9 is an exploded perspective view of a swing arm assembly of the paper handling device of FIG. 5.
Figure 10:
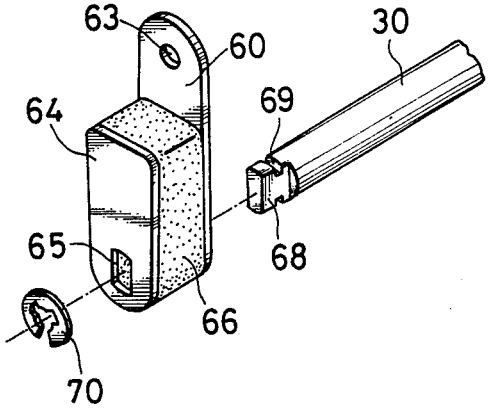
FIG. 10 is an exploded perspective view showing the swing arm assembly.
Figure 11:
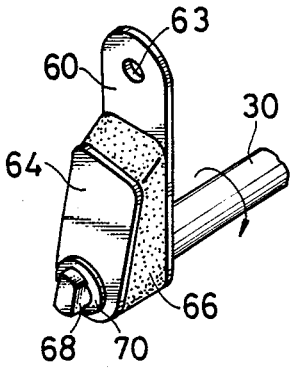
FIG. 11 is a perspective view showing the distortion of an elastic member of the swing arm assembly of FIG. 9.

An arrangement for connecting an elongated passive swing arm 60 to the operating shaft 30 will be described hereinafter with reference to FIGS. 9, 10, and 11. The elongated passive swing arm 60 has one end provided with a through hole 61 for receiving the operating shaft 30 in a loose fit and the other end provided with a through hole 63 for fixedly receiving a projection 62. An active swing arm 64 has one end provided with a slot 65 having two parallel sides. An elastic member 66, such as a rubber block, having a shape similar to that of the active swing arm 64 has one end provided with a through hole 67 for receiving the operating shaft 30 therethrough. The elastic member 66 is held between and joined adhesively to the elongated passive swing arm 60 and the active swing arm 64 to form an integral swing arm assembly. A holding portion 68 having two parallel flat surfaces is formed in one end of the operating shaft 30 opposite the other end fixedly connected to the manual lever 31. A groove 69 for receiving a retaining ring 70 is formed in the holding portion 68. The end having the holding portion 68 of the operating shaft 30 is inserted in the through holes of the integrated swing arm assembly from the side of the elongated passive swing arm 60 so that the holding portion 68 engages the slot 65, and then the retaining ring 70 is fitted in the groove 69 to hold the integrated swing arm assembly in place on the operating shaft 30. Thus, the active swing arm 64 is restrained from turning motion relative to the operating shaft 30.

Figure 7:
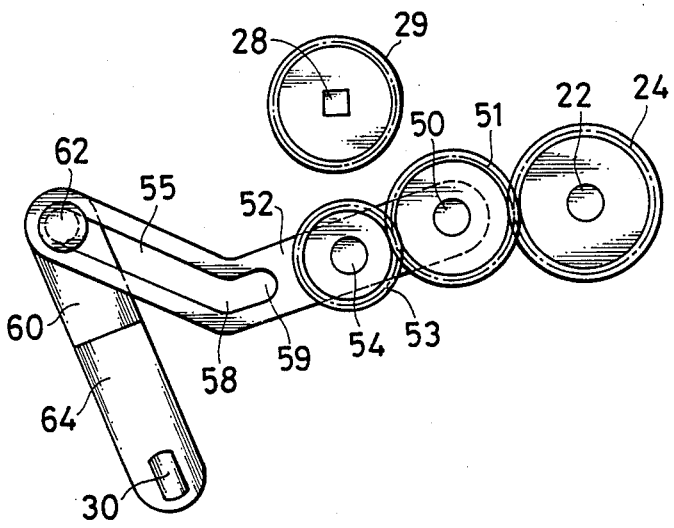
FIG. 7 is a diagrammatic illustration of a gear train of the paper handling device of FIG. 5, in which a tractor unit is not driven.

The projection 62 fixed to the elongated passive swing arm 60 is received slidably in the guide slot 55 of the crooked guide plate 52. When the pin 49 of the manual lever 31 engages the recess 47 (FIG. 5), the elongated passive swing arm 60 is tilted to the left, as viewed in FIG. 7, the projection 62 is positioned at the outer extremity of the guide slot 55, and the second idle gear 53 is disengaged from the tractor gear 29, as shown in FIG. 7. When the pin 49 of the manual lever 31 engages the recess 48 (FIG. 5), the elongated passive swing are 60 is tilted to the right, as viewed in FIG. 8, the projection 62 is positioned in the holding part 59 on the right-hand side of the bend 58, and the second idle gear 53 engages the tractor gear 29, as shown in FIG. 8.

In feeding a cut sheet for printing, the operating shaft 30 is turned in a counterclockwise direction, as viewed in FIG. 7, to turn the elongated passive swing arm 60 and the elastic member 66 together with the active swing arm 64 through a predetermined angle. Consequently, the projection 62 slides to the outer extremity of the crooked guide slot 55 of the guide plate 52 to turn the crooked guide plate 52 in a counterclockwise direction on the first shaft 50, and thereby the second idle gear 53 is disengaged from the tractor gear 29 to disconnect the tractor gear 29 from the driving unit and the second idle gear 53 is held at a standby position.

Figure 8:
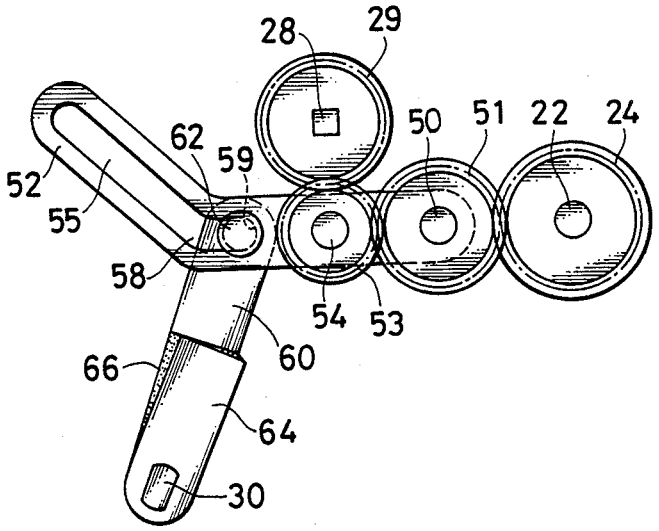
FIG. 8 is a diagrammatic illustration of the gear train of FIG. 7, in which the tractor unit is driven.

In feeding a fanfold paper for printing, the operating shaft 30, (and hence, the swing arm assembly including the elongated passive swing arm 60), is turned in a clockwise direction, as viewed in FIG. 8, through a predetermined angle. Consequently, the projection 62 slides along the guide slot 55 through the bend 58 to the holding part 59 to turn the crooked guide plate 52 in a clockwise direction on the first shaft 50, and thereby the second idle gear 53 is held in engagement with the tractor gear 29 to transmit power to the tractor gear 29.

As shown in FIG. 8, the holding part 59 is formed near the bend 58 of the guide slot 55. Even when a force urging the second idle gear 53 away from the tractor gear 29 (namely, a force acting to turn the guide plate 52 in a counterclockwise direction) acts on the second idle gear 53 in reversing the printer while the second idle gear 53 is in engagement with the tractor gear 29 and the projection 62 is resting in the holding part 59, a force acts on the projection 62 in a direction toward the operating shaft 30, and hence no large torque tending to turn the elongated passive swing arm 60 acts on the elongated passive swing arm 60. Accordingly, the second idle gear 53 is held securely in engagement with the tractor gear 29.

Figure 12:
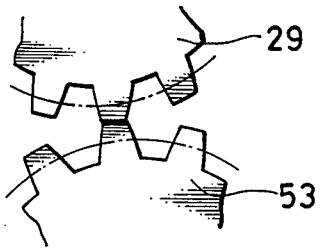
FIG. 12 is a fragmentary side elevation showing the tooth crests of mating gears in abutment with each other.
Figure 13:
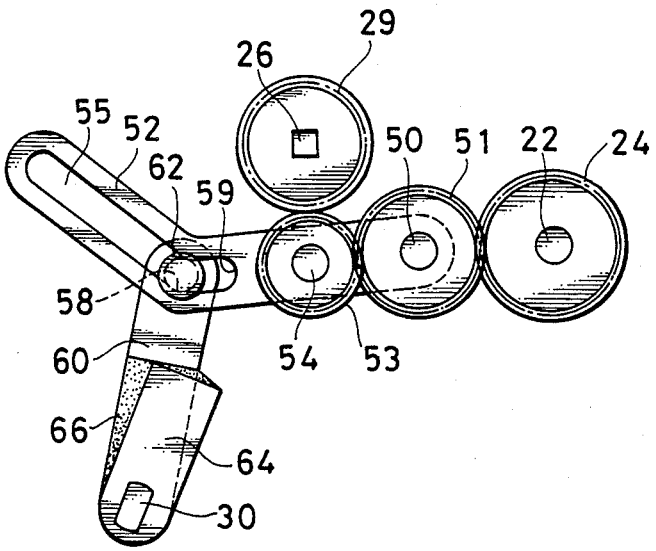
FIG. 13 is a side elevation of the gear train of the paper handling device of FIG. 5, showing the distortion of the elastic member of the swing arm assembly when the tooth crests of the mating gears in abutment with each other.

Practically, the tooth crests of most gears are flat. Therefore, in some cases, the tooth crests of the second idle gear 53 come into abutment with those of the tractor gear 29 in engaging the second idle gear 53 and the tractor gear 29. In such a case as shown in FIG. 12, the clockwise turning of the elongated passive swing arm 60 is checked before the elongated passive swing arm 60 is turned through the predetermined angle upon the collision of the tooth crests of the second idle gear 53 against those of the tractor gear 29, and hence the second idle gear 53 is unable to engage the tractor gear 29, and the projection 62 is unable to reach the holding part 59, whereas the active swing arm is turned forcibly through the predetermined angle distorting the elastic member 66, and thereby the elongated passive swing arm 60 is urged resiliently in the clockwise direction, and the second idle gear 53 is pressed against the tractor gear 29. When the first idle gear 51 is turned, the second idle gear 53 is driven positively for rotation. Then, the tooth crests of the second idle gear 53 escape form those of the tractor gear 29, the elongated passive swing arm 60 is allowed to be turned in the clockwise direction by the energy stored in the distorted elastic member 66, and the second idle gear 53 engages the tractor gear 29 properly. Since the energy stored in the distorted elastic member 66 is small, the second idle gear 53 and the tractor gear 29 are never damaged when the second idle gear 53 engages the tractor gear 29.

The predetermined angle through which the active swing arm 64 turns in bringing the second idle gear 53 into engagement with the tractor gear 29 is dependent on the distance between the center axis of the operating shaft 30 and the center axis of the pin 49 and the respective positions of the recesses 47 and 48 of the stopper 45. The predermined angle is set, taking into account the resilience of the elastic member 66, to an angle slightly greater than an angle through which the active swing arm 64 must be turned to make the second idle gear 53 engage the tractor gear 29. Accordingly, the second idle gear 53 is pressed continuously against the tractor gear 29 by the resilience of the slightly distorted elastic member 66 to keep the second idle gear 53 securely in engagement with the tractor gear 29 after the active swing arm 64 has been turned in a clockwise direction through the predetermined angle.

Although the crooked guide plate 52 is turned on the first shaft 50 rotatably supporting the first idle gear 51 in this embodiment, in a modification, the crooked guide plate 52 may be turned on the platen shaft 22 fixedly mounted with the platen gear 24.

Figure 14:
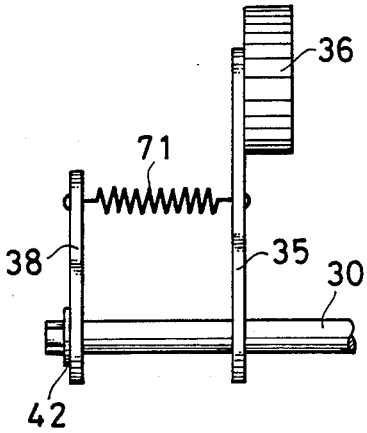
FIG. 14 is a front elevation showing an essential portion of a paper handling device in a third embodiment according to the present invention.

Third Embodiment (FIG. 14)

A third embodiment in accordance with the present invention is substantially similar in construction to the first embodiment. In the following description, parts of the third embodiment like or corresponding to those of the first embodiment are denoted by the same reference numberals and the description thereof will be omitted.

The third embodiment employs a tension coil spring 71 instead of the elastic member 40, such as a rubber block, employed in the first embodiment. The tension coil spring 71 has one end fixed to the passive swing arm 35 and the other end fixed to the active swing arm 38.

When the active swing arm 38 is turned, the passive swing arm 35 is dragged elastically through the tension coil sping 71 by the active swing arm 38, and thereby the idle gear 36 engages both the platen gear 24 and the tractor gear 29.

Figure 15:
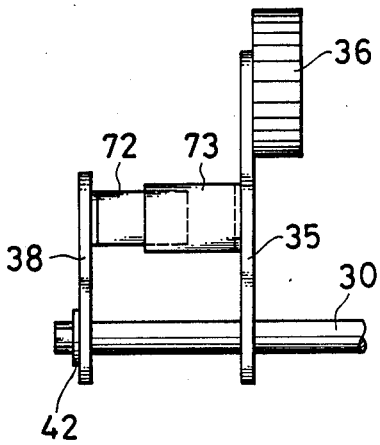
FIG. 15 is a front elevation showing an essential portion of a paper handling device in a fourth embodiment according to the present invention.

Fourth Embodiment (FIG. 15)

A fourth embodiment in accordance with the present invention is substantially similar in construction to the first embodiment. In the following description, parts of the fourth embodiment like or corresponding to those of the first embodiment are denoted by the same reference numerals and the description thereof will be omitted.

The fourth embodiment employs an elastic plate 72, such as a plate spring, fixed to the active swing arm 38, and an elastic plate 73, such as a plate spring, fixed to the passive swing arm 35, instead of the elastic member 40, such as a rubber block. The free ends of the elastic plates 72 and 73 are in contact with each other.

Accordingly, when the active swing arm 38 is turned, the passive swing arm 35 is turned elastically through the elastic plates 72 and 73 to bring the idle gear 29 into engagement with both the platen gear 24 and the tractor gear 29. The elastic plates 72 and 73 may be substituted by a single elastic plate having one end fixed to either the active swing arm 38 or the passive swing arm 35, and the other end engageing the passive swing arm 35 or the active swing arm 38.

Figure 16:
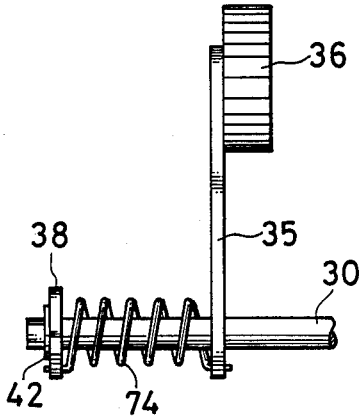
FIG. 16 is a front elevation showing an essential portion of a paper handling device in a fifth embodiment according to the present invention.
Figure 17:
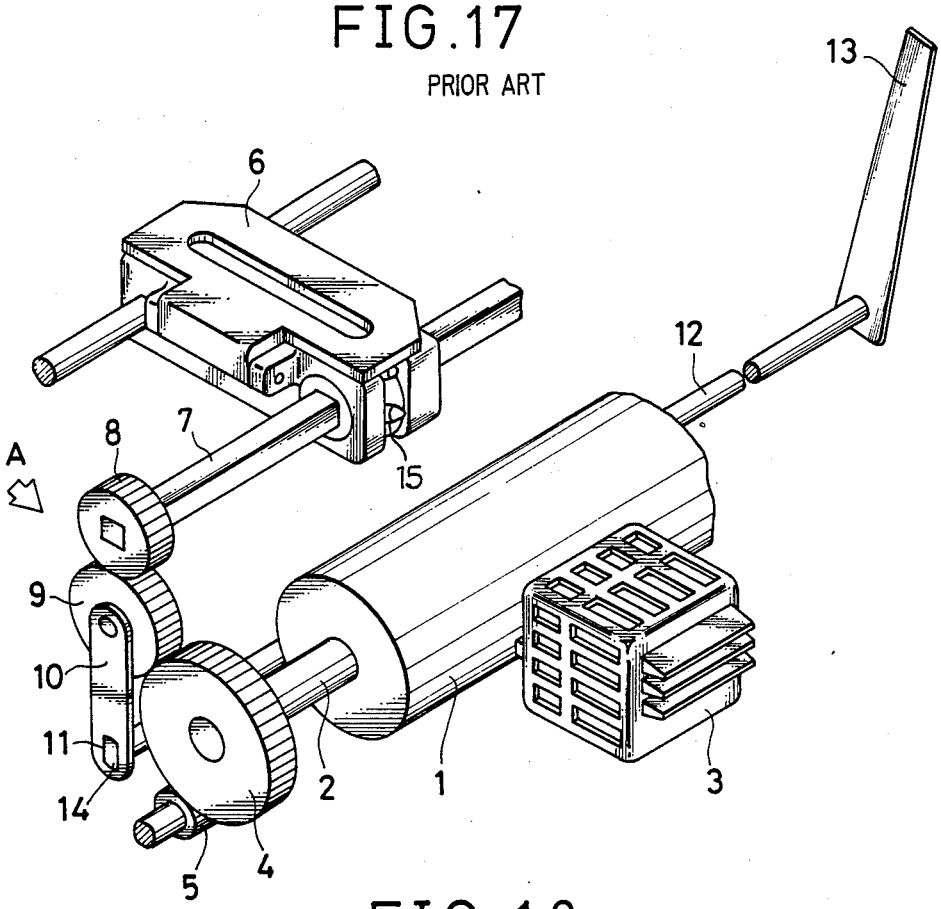
FIG.17 PRIOR ART
FIG. 17 is a perspective view of a conventional paper handling device.
Figure 18:
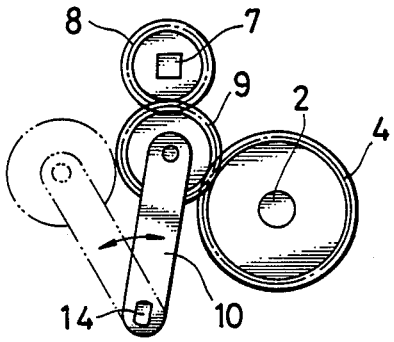
FIG.18 PRIOR ART
FIG. 18 is a side elevation showing a portion of the paper handling device of FIG. 17.

Fifth Embodiment (FIG. 16)

A fifth embodiment in accordance with the present invention is substantially the same in construction as the first embodiment, except that the fifth embodiment employs a torsion coil spring 74 instead of the elastic member 40, such as a rubber block. The torsion coil spring 74 has one end fixed to the active swing arm 38 and the other end fixed to the passive swing arm 35. The function of the torsion coil spring 74 is the same as that of the elastic member 40.

What is claimed is:

1. A paper handling device comprising:

(a) a platen mounted on a platen shaft;

(b) a first gear:

(i) mounted on said platen shaft and (ii) operatively connected to a driving pinion;

(c) a tractor unit mounted on a tractor driving shaft;

(d) a second gear:

(i) mounted on said tractor driving shaft, (ii) located in a plane including said first gear, and (iii) separated from said first gear;

(e) a first idle gear:

(i) that is rotatably mounted on a first shaft that extends in parallel to said platen and (ii) that continuously engages said first gear;

(f) a guide plate:

(i) pivotally mounted for swing motion on said first shaft between a first position and a second position and (ii) provided with a guide slot;

(g) a second idle gear:

(i) rotatably mounted on said guide plate;

(ii) continuously engaging said first idle gear, and (iii) which engages said second gear when said guide plate is in its first position and which does not engage said second gear when said guide plate is in its second position;

(h) an operating shaft extending in parallel to the respective axes of said first and second gears, said operating shaft being pivotally movable about its axis between a first position and a second position;

(i) an active swing arm mounted on said operating shaft for turning motion together with said operating shaft;

(j) a passive swing arm having:

(i) one end provided with a through hole receiving said operating shaft in a loose fit and (ii) the other end provided with a projection slidably received in said guide slot of said guide plate; and (k) an elastic member interrconnecting said active swing arm and said passive swing arm:

(i) so as to bias said passive swing arm toward turning motion in concert with the turning motion of said active swing arm, (ii) so as to bias said guide plate into its first position when said operating shaft is in its first position, and (iii) so as to bias said second idle gear into engagement with said second gear when said operating shaft is in its first position.

2. A paper handling device according to claim 1, wherein said guide slot of said guide plate has:

(i) a bend and (ii) a holding part for securely holding said projection of said passive swing arm in place when said operating shaft is in first position.

3. A paper handling device according to claim 1, wherein said driving pinion engages with said first gear.

4. A paper handling device according to claim 1, wherein said passive swing arm has an effective length greater than that of said active swing arm.

* * * * *